US011167298B2

(12) United States Patent
Duncan et al.

(10) Patent No.: US 11,167,298 B2
(45) Date of Patent: Nov. 9, 2021

(54) SPRAY GUN BARREL WITH INSEPARABLE NOZZLE

(71) Applicant: 3M INNOVATIVE PROPERTIES COMPANY, St. Paul, MN (US)

(72) Inventors: Brian E. Duncan, St. Paul, MN (US); Stephen C. P. Joseph, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 14/385,795

(22) PCT Filed: Mar. 6, 2013

(86) PCT No.: PCT/US2013/029244

§ 371 (c)(1),
(2) Date: Sep. 17, 2014

(87) PCT Pub. No.: WO2013/142045

PCT Pub. Date: Sep. 26, 2013

(65) Prior Publication Data

US 2015/0069142 A1 Mar. 12, 2015

Related U.S. Application Data

(60) Provisional application No. 61/614,752, filed on Mar. 23, 2012.

(51) Int. Cl.
*B05B 7/08* (2006.01)
*B05B 7/02* (2006.01)
(Continued)

(52) U.S. Cl.
CPC ..... *B05B 7/083* (2013.01); *B05B 7/02* (2013.01); *B05B 7/066* (2013.01); *B05B 7/2405* (2013.01)

(58) Field of Classification Search
CPC ..... B05B 7/0075; B05B 7/02; B05B 7/066; B05B 7/0815; B05B 7/083; B05B 7/0861;
(Continued)

(56) References Cited

U.S. PATENT DOCUMENTS 1,299,290 A 4/1919 Berg
1,539,536 A 5/1925 Bartling
(Continued)

FOREIGN PATENT DOCUMENTS

CN 3815327 11/1989
CN 1280885 1/2001
(Continued)

OTHER PUBLICATIONS

Ihmels, "Paint spray gun from the Edewecht Development Duo," Feb. 15, 1989, No. 7, pp. 13-14.
(Continued)

*Primary Examiner* — Cody J Lieuwen

(57) ABSTRACT

A barrel for use with a liquid spray gun platform to provide a liquid spray gun comprises a main body and an inseparable nozzle. The main body comprises at least one center air delivery passage and at least one liquid-handling passage. The inseparable nozzle defines a liquid-emitting orifice that is in fluid communication with the at least on liquid-handling passage of the main body, and defines a center air orifice that is in fluid communication with the at least on center air delivery passage of the main body.

23 Claims, 9 Drawing Sheets

(51) Int. Cl.
*B05B 7/06* (2006.01)
*B05B 7/24* (2006.01)

(58) Field of Classification Search
CPC ... B05B 7/2405; B05B 15/0431; B05B 7/067; B05B 7/068; B05B 1/26; B05B 7/2435
USPC ..... 239/290, 296, 300, 424, 526, DIG. 14
See application file for complete search history.

(56) References Cited

U.S. PATENT DOCUMENTS 1,748,440 A 2/1930 Burdick
2,042,746 A 6/1936 Tracy
2,059,706 A 11/1936 Paasche
2,126,888 A 8/1938 Jenkins
2,303,280 A 11/1942 Jenkins
2,362,946 A 11/1944 Stockdale
2,497,625 A 2/1950 Norwick
2,820,670 A 1/1958 Charlop
2,886,252 A 5/1959 Ehrensperger
2,904,262 A 9/1959 Peeps
2,991,940 A 7/1961 Dupler
3,062,453 A 11/1962 Matthews
3,157,360 A 11/1964 Heard
3,168,250 A 2/1965 Paasche
3,236,459 A 2/1966 McRitchie
3,270,920 A 9/1966 Nessler
3,515,354 A 6/1970 Presson
3,581,998 A 6/1971 Roche
3,623,669 A 11/1971 Woods
3,633,828 A 1/1972 Larson
3,876,150 A 4/1975 Dwyer
3,942,680 A 3/1976 Seeley
4,160,525 A 7/1979 Wagner
4,392,617 A 7/1983 Bakos
4,403,738 A 9/1983 Kern
4,513,913 A 4/1985 Smith
4,529,126 A 7/1985 Ives
4,537,357 A 8/1985 Culbertson
4,562,965 A 1/1986 Ihmels
4,615,485 A 10/1986 Larson
4,657,184 A 4/1987 Weinstein
4,660,774 A 4/1987 Kwok
4,712,739 A 12/1987 Bihn
4,760,962 A 8/1988 Wheeler
4,811,904 A 3/1989 Ihmels
4,815,666 A 3/1989 Gacka
4,817,872 A 4/1989 Mattson
4,830,281 A 5/1989 Calder
4,925,101 A 5/1990 Konieczynski
4,971,251 A 11/1990 Dobrick
4,993,642 A 2/1991 Hufgard
5,022,590 A 6/1991 Buschor
5,110,011 A 5/1992 Laska
5,119,992 A 6/1992 Grime
5,152,460 A 10/1992 Barty
5,178,330 A 1/1993 Rodgers
5,242,115 A 9/1993 Brown
5,279,461 A 1/1994 Darroch
5,280,853 A 1/1994 Perret, Jr.
5,322,221 A 6/1994 Anderson
5,332,156 A 7/1994 Wheeler
5,395,046 A 3/1995 Knobbe
5,454,517 A 10/1995 Naemura
5,456,414 A 10/1995 Burns
5,474,450 A 12/1995 Chronister
5,582,350 A 12/1996 Kosmyna
5,607,108 A 3/1997 Garlick
5,609,302 A 3/1997 Smith
5,613,637 A 3/1997 Schmon
5,711,421 A 1/1998 Guo
5,765,753 A 6/1998 Kieffer
5,875,971 A 3/1999 Morck
5,961,050 A 10/1999 Kitajima
5,979,797 A 11/1999 Castellano
6,012,651 A 1/2000 Spitznagel
6,019,294 A 2/2000 Anderson
6,056,213 A 5/2000 Ruta
6,068,203 A 5/2000 DeYoung
6,085,996 A 7/2000 Culbertson
D429,794 S 8/2000 Beaver
6,098,902 A 8/2000 Culbertson
6,105,881 A 8/2000 Kitajima
6,254,015 B1 7/2001 Abplanalp
6,345,776 B1 2/2002 Hurray
6,360,992 B1 * 3/2002 Stanko ..... B64F 5/0063 239/290
6,375,096 B1 4/2002 Rashidi
6,425,536 B2 7/2002 Namura
6,450,422 B1 9/2002 Maggio
6,460,787 B1 10/2002 Hartle
6,471,144 B1 * 10/2002 Huang ..... B05B 7/0815 239/290
6,494,387 B1 12/2002 Kaneko
6,502,763 B1 1/2003 McCann
6,536,687 B1 3/2003 Navis
6,543,705 B1 4/2003 Liao
6,601,782 B1 8/2003 Sandholm
6,685,106 B1 2/2004 Van der Steur
6,702,198 B2 3/2004 Tam
6,719,212 B1 4/2004 Leisi
6,749,132 B2 6/2004 Pettit
6,793,155 B2 9/2004 Huang
6,805,306 B1 10/2004 Huang
6,808,122 B2 10/2004 Mitcheli
6,820,824 B1 11/2004 Joseph
6,854,667 B2 2/2005 Ulrich
6,860,438 B1 3/2005 Huang
6,874,702 B2 4/2005 Turnbull
6,935,577 B2 8/2005 Strong
6,953,155 B2 10/2005 Joseph
6,971,590 B2 12/2005 Blette
7,032,839 B2 4/2006 Blette
7,083,119 B2 8/2006 Bouic
7,097,118 B1 8/2006 Huang
7,165,732 B2 1/2007 Kosmyna
D538,886 S 3/2007 Huang
7,201,336 B2 4/2007 Blette
D542,375 S 5/2007 Blette
D542,376 S 5/2007 Blette
7,213,774 B1 5/2007 Kitajima
7,237,727 B2 * 7/2007 Wang ..... B05B 7/0815 239/290
7,246,759 B2 7/2007 Turnbull
D548,816 S 8/2007 Schmon
7,328,855 B2 2/2008 Chatron
RE40,433 E 7/2008 Schmon
D572,343 S 7/2008 Huang
7,484,676 B2 2/2009 Joseph
7,513,443 B2 4/2009 Escoto, Jr.
7,694,896 B2 4/2010 Turnbull
D616,527 S 5/2010 Anderson
7,712,682 B2 5/2010 Joseph
7,757,972 B2 7/2010 Kosmyna
7,789,324 B2 9/2010 Bouic
7,789,327 B2 9/2010 Micheli
7,798,061 B2 9/2010 Dilou
7,891,588 B2 2/2011 Jones
7,922,107 B2 4/2011 Fox
7,971,806 B2 7/2011 Johnson
8,066,205 B2 11/2011 Bass
8,297,536 B2 10/2012 Ruda
8,313,047 B2 11/2012 Micheli
8,360,345 B2 1/2013 Micheli
8,500,043 B2 8/2013 Heigl
8,590,809 B2 11/2013 Escoto, Jr. et al.
8,684,281 B2 4/2014 Micheli
2002/0104898 A1 8/2002 Bonnique
2003/0071144 A1 4/2003 Naemura
2003/0111553 A1 6/2003 Hunter
2003/0173419 A1 9/2003 Huang
2004/0089742 A1 5/2004 Antonucci
2004/0140373 A1 7/2004 Joseph
2004/0195401 A1 10/2004 Strong

(56) References Cited

U.S. PATENT DOCUMENTS

| | | | | |
|---|---|---|---|---|
| 2004/0245673 | A1 | 12/2004 | Allsop | |
| 2004/0256484 | A1 | 12/2004 | Joseph | |
| 2004/0256493 | A1 | 12/2004 | Turnbull | |
| 2005/0016448 | A1 | 1/2005 | Dilou | |
| 2005/0035220 | A1 | 2/2005 | Brown | |
| 2005/0045741 | A1 | 3/2005 | Brown | |
| 2005/0087128 | A1 | 4/2005 | Jakupovic | |
| 2005/0145724 | A1 | 7/2005 | Blette | |
| 2005/0173561 | A1 | 8/2005 | Cotter | |
| 2005/0189445 | A1* | 9/2005 | Hartle | B05B 1/3046 239/691 |
| 2006/0000927 | A1 | 1/2006 | Ruda | |
| 2006/0065761 | A1 | 3/2006 | Joseph | |
| 2006/0097070 | A1 | 5/2006 | Huffman | |
| 2006/0102550 | A1 | 5/2006 | Joseph | |
| 2006/0175433 | A1 | 8/2006 | Escoto, Jr. | |
| 2006/0186223 | A1 | 8/2006 | Wang | |
| 2007/0102535 | A1 | 5/2007 | Carey | |
| 2007/0154636 | A1* | 7/2007 | Hashizume | B05B 7/066 427/240 |
| 2007/0262169 | A1 | 11/2007 | Wang | |
| 2007/0262172 | A1* | 11/2007 | Huffman | B05B 7/066 239/390 |
| 2008/0078849 | A1 | 4/2008 | Fox | |
| 2008/0093479 | A1 | 4/2008 | Delbridge | |
| 2008/0272213 | A1* | 11/2008 | Ting | B05B 7/0815 239/461 |
| 2009/0026290 | A1 | 1/2009 | Fox | |
| 2009/0121048 | A1 | 5/2009 | Noshima | |
| 2009/0302133 | A1 | 12/2009 | Micheli | |
| 2010/0108783 | A1 | 5/2010 | Joseph | |
| 2010/0123024 | A1 | 5/2010 | Gohring | |
| 2010/0133358 | A1 | 6/2010 | Goehring | |
| 2010/0163645 | A1 | 7/2010 | Johnson | |
| 2010/0187333 | A1 | 7/2010 | Escoto, Jr. | |
| 2010/0282868 | A1 | 11/2010 | Heigl | |
| 2011/0168811 | A1 | 7/2011 | Fox | |
| 2013/0092760 | A1 | 4/2013 | Joseph | |
| 2013/0327850 | A1 | 12/2013 | Joseph | |
| 2014/0014741 | A1 | 1/2014 | Escoto | |
| 2014/0246519 | A1 | 9/2014 | Johnson | |
| 2015/0028131 | A1 | 1/2015 | Joseph | |

FOREIGN PATENT DOCUMENTS

| | | | |
|---|---|---|---|
| CN | 2431971 | | 5/2001 |
| CN | 1827231 | | 9/2006 |
| DE | 4027421 | | 3/1992 |
| DE | 4302911 | | 8/1993 |
| DE | 19503495 | | 8/1996 |
| DE | 19605227 | | 8/1997 |
| DE | 10315426 | | 6/2004 |
| DE | 60005536 | | 7/2004 |
| DE | 102004027789 | | 2/2005 |
| DE | 102004044475 | | 12/2005 |
| DE | 102007012989 | | 10/2007 |
| DE | 202011050102 | | 9/2011 |
| EP | 0279992 | | 8/1988 |
| EP | 0509367 | | 10/1992 |
| EP | 0492333 | | 3/1995 |
| EP | 0885658 | | 12/1998 |
| EP | 1340550 | | 9/2003 |
| EP | 1479447 | | 11/2004 |
| EP | 1554051 | | 4/2006 |
| EP | 1682231 | | 7/2006 |
| EP | 1699565 | | 6/2008 |
| EP | 1964616 | | 9/2008 |
| EP | 2108460 | | 10/2009 |
| EP | 2386360 | | 11/2011 |
| EP | 2486985 | | 8/2012 |
| GB | 425382 | | 9/1934 |
| GB | 829370 | | 3/1960 |
| GB | 1231041 | | 5/1971 |
| GB | 1293341 | | 10/1972 |
| GB | 1338099 | | 11/1973 |
| JP | S62227458 | A | 10/1987 |
| JP | 63-39448 | | 3/1988 |
| JP | 6226149 | A | 8/1994 |
| JP | 6262103 | A | 9/1994 |
| JP | H07-265751 | | 10/1995 |
| JP | 8141448 | A | 6/1996 |
| JP | 9019651 | A | 1/1997 |
| JP | H1028906 | | 2/1998 |
| JP | 11-114458 | | 4/1999 |
| JP | 2002-1169 | | 1/2002 |
| JP | 2003-112086 | | 4/2003 |
| JP | 2005-211699 | | 8/2005 |
| JP | 2006263709 | A | 10/2006 |
| JP | 2007-175650 | | 7/2007 |
| KR | 10-0435685 | | 6/2004 |
| KR | 20-0428831 | | 10/2006 |
| NL | 1024774 | | 3/2004 |
| RU | 2014906 | | 6/1994 |
| SU | 172206 | | 1/1965 |
| WO | WO 03/051524 | | 6/2003 |
| WO | WO 2004-037432 | | 5/2004 |
| WO | WO 2004-037433 | | 5/2004 |
| WO | WO 2004/087332 | | 10/2004 |
| WO | WO 2005-049145 | | 6/2005 |
| WO | WO 2005/063361 | | 7/2005 |
| WO | WO 2006-053229 | | 5/2006 |
| WO | WO 2006/098623 | | 9/2006 |
| WO | WO 2006/107935 | | 10/2006 |
| WO | WO 2007/056589 | | 5/2007 |
| WO | WO 2007/104967 | | 9/2007 |
| WO | WO 2007-139639 | | 12/2007 |
| WO | WO 2008/016557 | | 2/2008 |
| WO | WO 2008/029229 | | 3/2008 |
| WO | WO 2012-109298 | | 8/2012 |
| WO | WO 2013-016474 | | 1/2013 |
| WO | WO 2013-055730 | | 4/2013 |

OTHER PUBLICATIONS

International Search Report for PCT International Application No. PCT/US2013/029244 dated Jun. 21, 2013, 4 pages.

* cited by examiner

SPRAY GUN BARREL WITH INSEPARABLE NOZZLE

CROSS REFERENCE TO RELATED APPLICATIONS

This application is a national stage filing under 35 U.S.C. 371 of PCT/US2013/029244, filed Mar. 6, 2013, which claims priority to U.S. Provisional Application No. 61/614,752, filed Mar. 23, 2012, the disclosures of which are incorporated by reference in their entireties herein.

BACKGROUND

Spray guns are used in many different facilities to spray liquids for a wide variety of purposes. For example, spray guns are widely used in vehicle body repair shops when spraying a vehicle with liquid coating media, e.g., primer, paint and/or clearcoat. Often, such spray guns are configured to emit liquid from one or more liquid-emitting orifices; and, to emit so-called center air from one or more center air orifices, which center air may assist in atomizing the liquid into a spray of small droplets; and, to emit so-called fan air from one or more fan air orifices, which fan air may assist in both shaping the spray of atomized liquid droplets into a desired pattern and may further assist in atomizing the liquid.

SUMMARY

Disclosed herein in various aspects is a barrel for use in a liquid spray gun, comprising an inseparable nozzle that defines a center air orifice. These and other aspects of the invention will be apparent from the detailed description below. In no event, however, should the above summaries be construed as limitations on the claimable subject matter, whether such subject matter is presented in claims in the application as initially filed or in claims that are amended or otherwise presented in prosecution.

Figure 1:
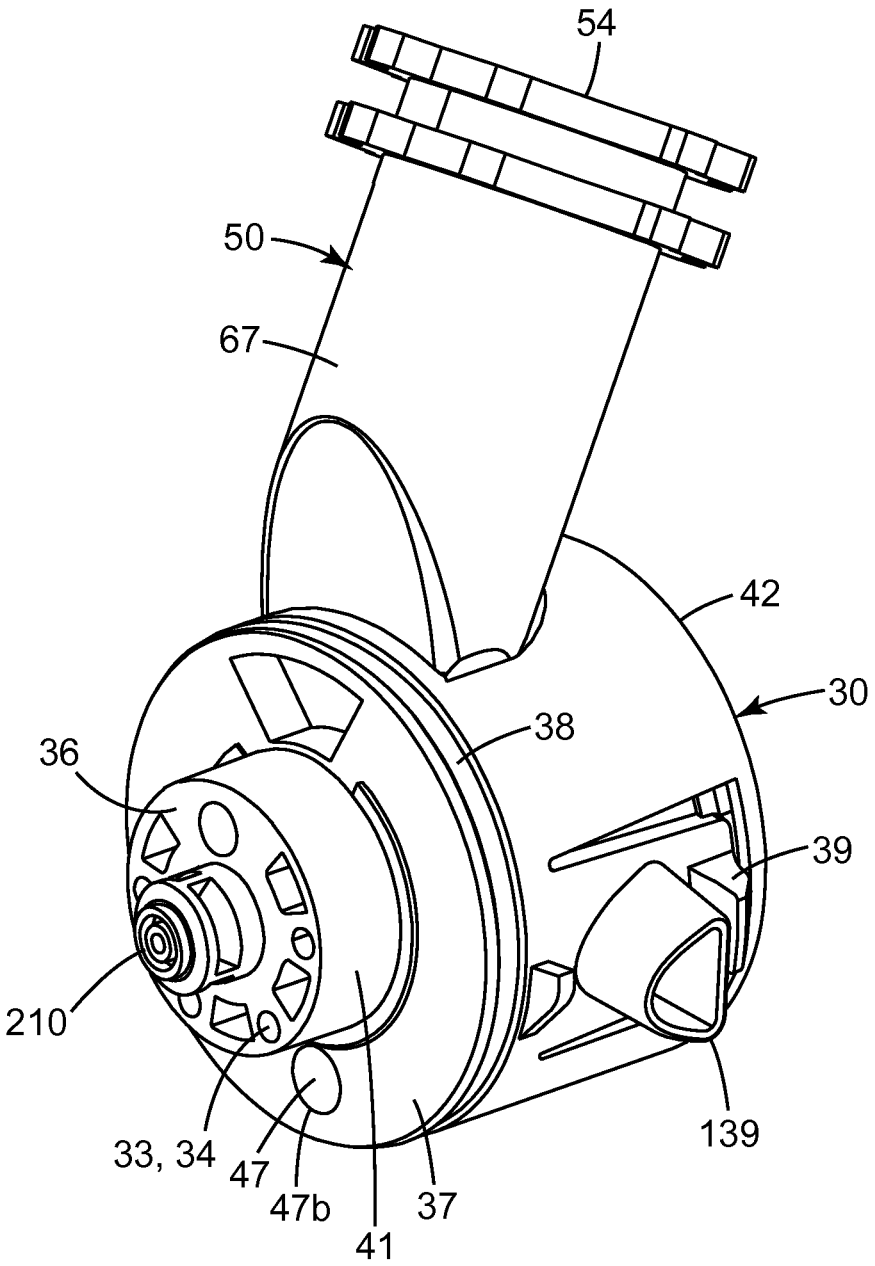
FIG. 1 is an perspective view of an exemplary barrel comprising an exemplary inseparable nozzle.

Like reference numbers in the various figures indicate like elements. Some elements may be present in identical or equivalent multiples; in such cases only one or more representative elements may be designated by a reference number but it will be understood that such reference numbers apply to all such identical elements. Unless otherwise indicated, all figures and drawings in this document are not to scale and are chosen for the purpose of illustrating different embodiments of the invention. In particular the dimensions of the various components are depicted in illustrative terms only, and no relationship between the dimensions of the various components should be inferred from the drawings, unless so indicated.

Although terms such as "top", bottom", "upper", lower", "under", "over", "front", "back", "outward", "inward", "up" and "down", and "first" and "second" may be used in this disclosure, it should be understood that those terms are used in their relative sense only unless otherwise noted. Terms such as front, front-facing, forward, forwardmost, etc., refer to directions toward the end of a liquid spray gun from which liquid spray is emitted (e.g., toward the left side of FIGS. 1, 4 and 9), and terms such as rear, rear-facing, rearward, rearwardmost, etc., refer to directions toward the opposing end of a liquid spray gun (e.g., toward the right side of FIGS. 1, 4 and 9). Terms such as internal, inward, inward-facing, inwardmost, etc., refer to directions toward the interior of a barrel or a component thereof; terms such as external, outward, outward-facing, outwardmost, etc., refer to directions toward the exterior of a barrel or a component thereof. Terms such as radially (as in radially-outward, radially-inward, etc.) are with respect to a longitudinal axis of an elongated component and/or with respect to an axis generally aligned with the flow of a fluid along a path, noting that the terms do not require a strict ninety degree relationship with respect to such axes and does not require a strictly circular geometry (e.g., of a surface described e.g. as "radially-outwardly facing").

DETAILED DESCRIPTION

Disclosed herein is a barrel that may be mated to a liquid spray gun platform to form a liquid spray gun and that comprises an inseparable nozzle. One illustrative embodiment of an exemplary barrel 30 comprising an inseparable nozzle 210 is shown in perspective view in FIG. 1. By inseparable is meant that nozzle 210 cannot be removed from the main body of barrel 30 (i.e., without unacceptably damaging or destroying nozzle 210 and/or barrel 30). In some embodiments, nozzle 210 and the main body of barrel 30 may be a unitary piece of piece of integrally molded plastic, meaning that nozzle 210 and barrel 30 are molded as one piece, in a single molding operation. In other embodiments, nozzle 210 may be initially manufactured as a separate piece that is then inseparably attached to barrel 30. Such inseparable attachment may be performed e.g. by the use of sufficiently strong adhesive, ultrasonic bonding, solvent bonding, and the like. Or, it may be achieved by mechanical attachment (e.g., snap-fit attachment, riveting, or the like) that is performed in such manner that nozzle 210 cannot be removed from barrel 30 without unacceptable damage or destruction resulting.

Inseparable barrel 30 comprises a center air orifice. A center air orifice is an orifice (e.g., an annular orifice) that substantially, or completely, surrounds a liquid-emitting (spray) orifice of a spray gun such that the center air passing through the center air orifice can advantageously atomize and form the liquid emerging from the liquid-emitting orifice into stream of fine droplets. It will be appreciated that designs in the art have often been of the general type in which a center air orifice of a spray gun is defined by surfaces of a first component (e.g., a component that is mated to a gun platform and that receives air from the gun platform) in combination with surfaces of a second component (e.g., an air cap that is mated to the first component). In contrast, in the disclosures herein, a center air orifice (as well as a liquid-emitting orifice) is defined only by surfaces of barrel 30 (specifically, by surfaces of inseparable nozzle 210). It will be appreciated that defining a center air orifice by way of surfaces that do not move relative to each other (e.g. in assembly, use, or servicing of a liquid spray gun) may enhance the ability of the center air to consistently and uniformly atomize the liquid stream.

Barrel 30 comprises at least one center air passage that acts, directly or indirectly, to deliver center air to a center air orifice of inseparable nozzle 210. Barrel 30 may also comprise at least one fan air passage that acts at least in part to deliver fan air through a fan air passage outlet (e.g., into a fan air chamber as disclosed later herein). For example as depicted in the illustrative embodiment of FIGS. 1 and 4-6, exemplary barrel 30 may comprise at least one center air passage 33 that acts at least in part to deliver center air to center air orifice 72 of inseparable nozzle 210. As shown in exemplary illustration in FIGS. 4-5, the at least one center air passage 33 may fluidly connect a center air passage inlet 31 located at a rear face 42 of barrel 30, to a center air passage outlet 34 located on a center air delivery face 36 of barrel 30. (It is noted that in the cross-sectional views of FIGS. 4 and 5, portions of barrel 30 are shown in additional cutaway (rather than in a strictly vertical cross-sectional view) so that center air passage 33 may be most easily seen. In addition, in FIGS. 4 and 5 some background surface lines have been omitted for clarity of presentation.) In the illustrative embodiment of FIGS. 1 and 4-6, multiple separate center air passages 33, each fluidly connected to a separate center air passage outlet 34, are provided, with the multiple center air passages 33 and outlets 34 thereof being arranged in an arc generally surrounding radially centrally located elongate hollow chamber 56/liquid-handling passage 53. However, any suitable configuration or arrangement of chamber 56 and center air passages 33 and outlets 34 may be used.

Figure 4:
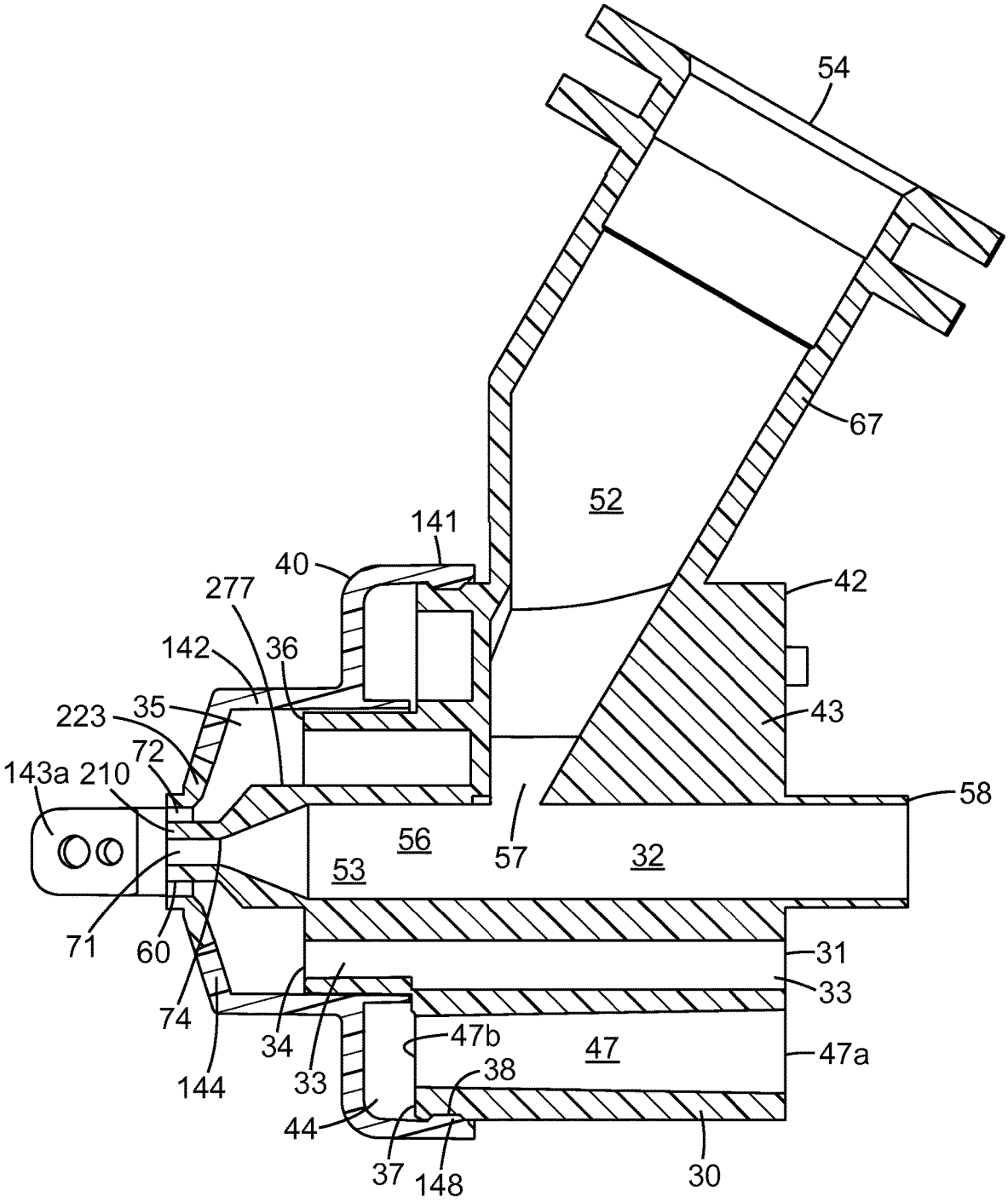
FIG. 4 is a cross-sectional view of an exemplary barrel of the general type shown in FIG. 1, with an exemplary air cap in place thereon.
Figure 5:
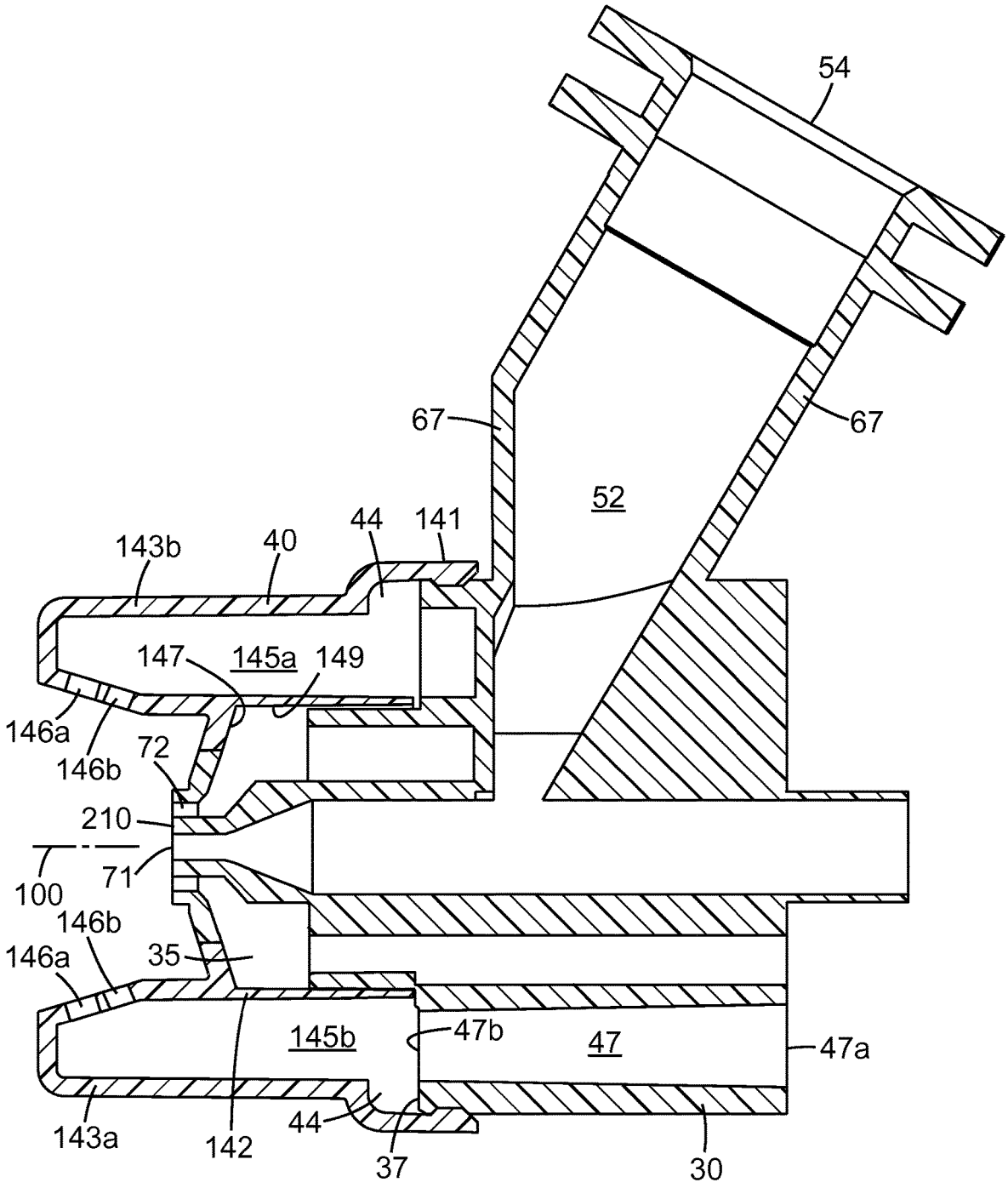
FIG. 5 is a cross-sectional view of the exemplary barrel and air cap of FIG. 4, with the air cap rotated approximately ninety degrees relative to the view depicted in FIG. 4.
Figure 6:
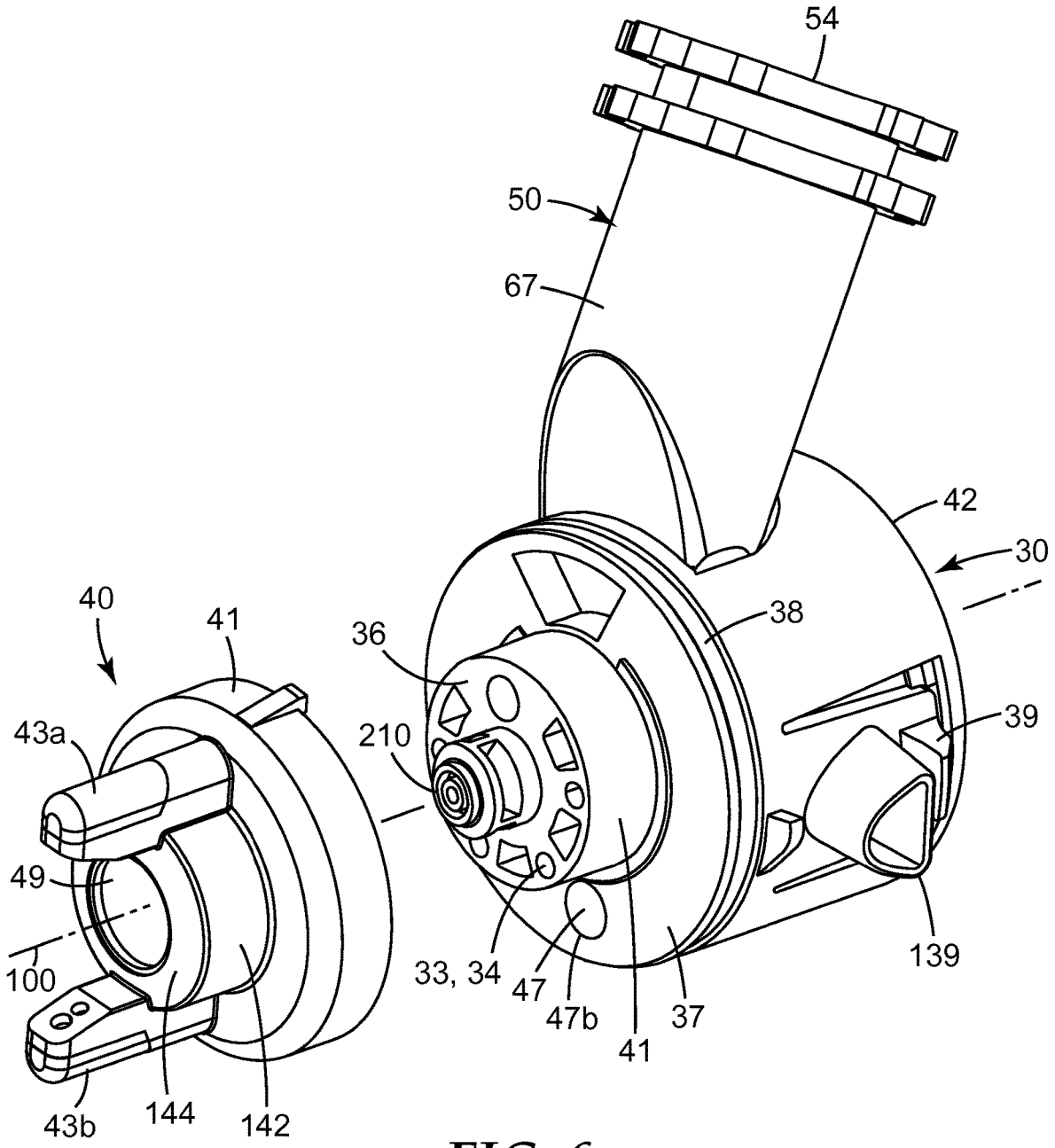
FIG. 6 is an exploded perspective view of an exemplary barrel with an exemplary air cap.

Again as shown in FIGS. 1 and 4-6, barrel 30 may comprise at least one fan air passage 47 that acts at least in part to deliver fan air to fan air chamber 44 that may be collectively defined e.g. by barrel 30 and air cap 40 as explained later in detail. As shown in exemplary illustration in FIGS. 4-5, fan air passage 47 may fluidly connect a fan air passage inlet 47*a* located at a rear face 42 of barrel 30, to a fan air passage outlet 47*b* located on a fan air delivery face 37 of barrel 30. Although in the exemplary design fan air passage outlet 47*b* is positioned below the center air passage outlets 34, and near a lowermost portion of barrel 30 (e.g., at an approximately six o'clock position on annular face 37 of barrel 30, as shown in FIGS. 1 and 6), outlet 47*b* can be located at any suitable position.

In such embodiments, annular, front-facing surfaces (e.g., center air delivery face 36 and fan air delivery face 37) of barrel 30 may be provided and may e.g. respectively at least partially define a center air chamber and/or a fan air chamber, as discussed in detail later herein. In the illustrated embodiment of FIGS. 1 and 4-6, center air delivery face 36 is positioned forward of fan air delivery face 37. In such cases at least forwardmost portions of center air passages 33 may be at least partially bounded by radially-outward-facing surface 41 of barrel 30. (It should be noted that in the discussions herein, terms such as annular, annulus, and the like, are used for convenience of description, and do not require that any of the described components must necessarily be provided in a strictly circular geometry.)

It will be noted that in the exemplary designs of barrel 30 illustrated herein, center air and fan air are handled by separate air-handling passages, that receive air from separate air supply conduits of gun platform 10. Such designs may be convenient but it may also be possible to obtain center air and fan air from a common source and/or to handle them collectively at least in part in mixed-air passages. It will also be noted that various hollow portions, cutouts and the like, are present in the exemplary barrel 30 as depicted in the Figures. Those of ordinary skill will appreciate that such features may serve e.g. to minimize the weight and/or raw material cost of such components, while maintaining the mechanical strength and integrity thereof. The presence of such features should not obscure or detract from the various elements (liquid-handling passages, air-handling passages, etc.) discussed herein. Also, in some embodiments, portions (e.g., rearward portions) of barrel 30 may be generally solid (except for the herein-discussed passages); or, some portions of barrel 30 may be generally hollow (which hollow spaces may or may not form part of e.g. an air-handling passage) except for optional supporting members (such as ribs or struts), such as the exemplary supporting member 43 depicted in FIG. 4.

Figure 2:
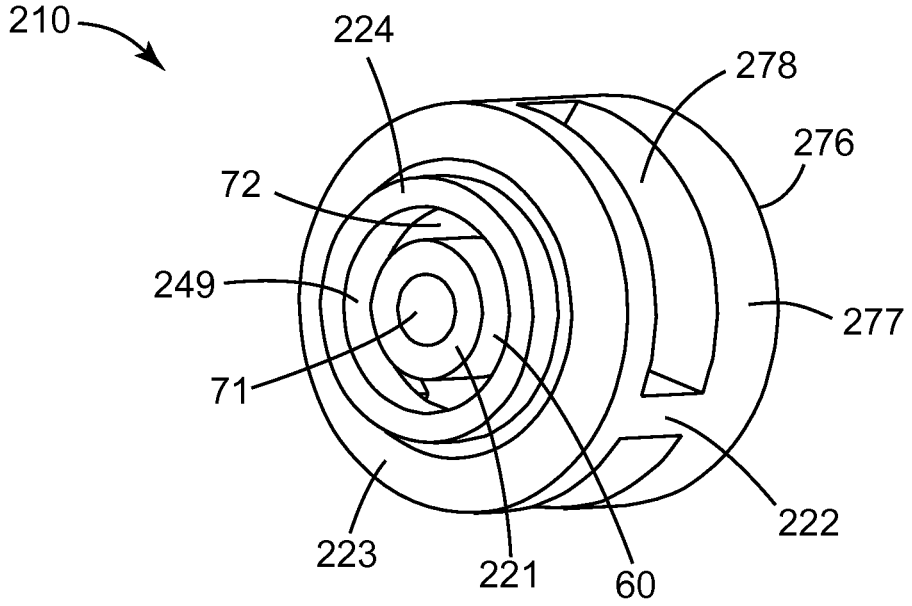
FIG. 2 is an enlarged isolated perspective view of the nozzle of FIG. 1.
Figure 3:
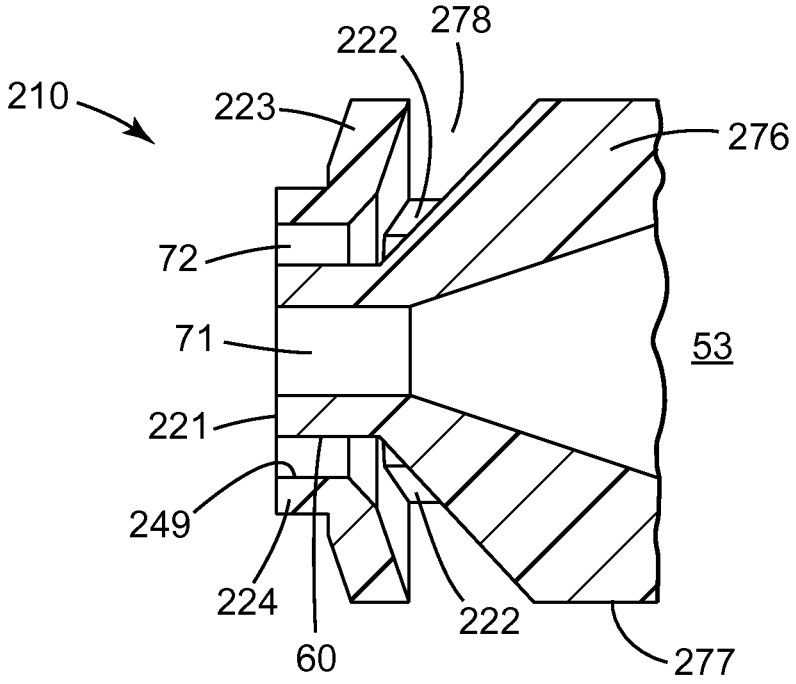
FIG. 3 is an enlarged isolated cross-sectional view of the nozzle of FIG. 1.

In further detail, exemplary inseparable nozzle 210 of barrel 30 is shown in isolated perspective front view in FIG. 2 and in isolated cross-sectional view in FIG. 3 (with other components of barrel 30 omitted for clarity in both Figures). Inseparable nozzle 210 may comprise annular tip 221 that defines liquid-emitting orifice 71 that is fluidly connected to liquid-handling passage 53 of barrel 30. Inseparable nozzle 210 may further comprise flange 223 at least a portion of which is generally radially outwardly separated from tip 221 of inseparable nozzle 210 so that center air orifice 72 is defined therebetween. Specifically, radially-outward-facing surface 60 of tip 221 may combine with radially-inward-facing surface 249 of rim 224 of flange 223, to define center air orifice 72 therebetween. Flange 223 may be supported e.g. by at least one rib 222 that is connected to other portions (e.g., shank portion 276) of nozzle 210, as seen most easily in FIG. 2. Rib(s) 222 may thus occupy a portion of nozzle air passages 278, in such manner as to not unacceptably impede center air flow therethrough.

In some embodiments, center air orifice 72 may be supplied with center air from center air chamber 35 (shown in FIGS. 4-5 and discussed in further detail later herein). In embodiments of this general type, center air may flow along the radially-outward face 277 of rearward portion (shank) 276 of nozzle 210, and then may enter nozzle air passage(s) 278 of nozzle 210, which passage(s) is in fluid communication with center air orifice 72 of nozzle 210. Embodiments of this type, in which center air flows (e.g., from a center air chamber) outside of nozzle 210 along at least a portion of the flow path leading to center air orifice 72, will be termed "external" center air flow. As will be seen, in other embodiments center air may reach center air orifice 72 by way of "internal" center air flow that is contained within the body of nozzle 210. Whether external or internal center air flow is used, center air orifice 72 (and liquid-emitting orifice 71) is defined only by surfaces of barrel 30 (specifically, by surfaces of inseparable nozzle 210 of barrel 30).

Barrel 30 comprises at least one liquid-handling passage 53 that fluidly connects liquid-handling passage inlet 54 of barrel 30 and liquid-emitting orifice 71 of inseparable nozzle 210 of barrel 30. As shown in exemplary illustration in FIGS. 4-5, liquid-handling passage 53 may conveniently comprise elongate hollow chamber 56 and may further comprise liquid-entry passage 52 which receives liquid through liquid-handling passage inlet 54 and which delivers liquid into elongate hollow chamber 56 via liquid-handling junction 57 as seen in FIG. 4. Hollow chamber 56 may be configured to admit needle 14 of gun platform 10 (as discussed later with reference to FIG. 9) that is capable of closing liquid-handling passage 53 (so that no liquid flows through liquid-emitting orifice 71) when advanced in the forward direction (to the left in FIGS. 4-5 and 9) and opening liquid-handling passage 53 when retracted in the rearward direction (to the right in FIGS. 4-5 and 9).

Elongate hollow chamber 56 may comprise a longitudinal axis that may be generally parallel to the direction of flow of liquid through liquid-handling passage 53 (after such liquid has entered hollow chamber 56 through liquid-handling junction 57) and through liquid-emitting orifice 71. (This direction of liquid flow may be generally parallel to axis 100 of liquid flow out of liquid-emitting orifice 71 as seen e.g. in FIGS. 5-6). In some embodiments a hollow shank 58 of barrel 30 may extend rearward to or past a rear face 42 of barrel 30, and may extend rearward into shank-receiving opening 19*c* of gun platform 10 when gun 1 is assembled (as discussed later in reference to FIG. 9). In some embodiments barrel 30 may include an angled protruding portion 67 that is hollow so as to comprise liquid-entry passage 52, as seen e.g. in FIGS. 4-5. By angled is meant that a longitudinal axis of protruding portion 67 is not coincident with the longitudinal axis of elongate hollow chamber 56. Although, in the illustrated embodiment, protruding portion 67 is shown extending upward and rearward from chamber 56 at an angle of approximately 60 degrees, any suitable angle and orientation may be chosen. For example, portion 67 may protrude at an angle of approximately 90 degrees (i.e., generally straight out at a right angle from the longitudinal axis of chamber 56); or, it may protrude in a forward rather than a rearward direction. Moreover, portion 67 may protrude downward, or to the side, rather than upward. The ordinary artisan will recognize that various of these arrangements may be more convenient e.g. for gravity-feed spray guns, for siphon-feed spray guns, for positive-air-pressure-feed spray guns, and so on, all of which are within the scope of the disclosures herein.

In some embodiments, protruding portion 67 and liquid-handling passage inlet 54 thereof may be configured to mate with a separate container that contains the liquid to be sprayed. In such embodiments, protruding portion 67 may comprise any suitable connection with such a container; e.g., in specific embodiments, protruding portion 67 may comprise a closure member (e.g. a plug, seal, lid, etc.) that forms the closure of a container that is connectable to protruding portion 67 and that can contain the liquid to be sprayed. In other embodiments, protruding portion 67 may comprise an integral container portion, e.g. an integrally molded container portion with an opening into which the liquid may be poured.

Barrel 30 may be made of any suitable material, including e.g. metals, metal alloys, plastics (e.g., moldable thermoplastic polymer resins, optionally containing any suitable additives, reinforcing fillers, etc., for any desired purpose), and the like, and any combinations thereof. In some embodiments, barrel 30 may be (e.g., consist of) a single unitary piece of integrally molded plastic. In alternative embodiments, barrel 30 may comprise two or more pieces e.g. that are attached, e.g. inseparably attached, to each other (e.g., adhered to each other by adhesive, snap-fitted together, welded together, etc.) to form barrel 30. Inseparable nozzle 210, if not made of the same material as barrel 30 (e.g., if not integrally molded therewith), can be made of any suitable material, as long as such material allows nozzle 210 to be inseparably attached to barrel 30.

In some embodiments, an air cap may be used with (e.g., attached to) barrel 30. An air cap is broadly defined herein as a device that directs fan air onto a spray of liquid that is emitted from a liquid-emitting orifice (e.g., 71) of the barrel and that is atomized by center air emitted from a center air orifice (e.g., 72) of the inseparable nozzle of the barrel. An exemplary air cap 40 that may be used with a barrel 30 of the general type pictured in FIGS. 1-3 is shown (mounted onto barrel 30) in cross-sectional view in FIGS. 4-5 and in perspective exploded view in FIG. 6. As shown in FIG. 6, air cap 40 may comprise flange 144 defining opening 49 that is sufficiently large in size (e.g., diameter) so as to permit inseparable nozzle 210 to function as described above. That is, opening 49 may be large enough so as to not block or obscure center air orifice 72 or liquid-emitting orifice 71. In some embodiments, it may be useful to configure flange 144 of air cap 40 so that it abuts, contacts, overlaps, or underlies e.g. a radially-outward portion of skirt 223 of nozzle 210, e.g. as shown in FIG. 4. (It will be appreciated that in the below-discussed embodiments in which air cap 40 helps define a fan air chamber and/or a center air chamber, such abutting etc. may help minimize air leaks and the like.)

In some embodiments, air cap 40 may combine with barrel 30 to define a fan air chamber. For example, with reference to the exemplary illustrations of FIGS. 4-6, air cap 40 (e.g., various rearward-facing and/or radially-inwardly-facing surfaces thereof) may combine with barrel 30 (e.g., various forward-facing and/or radially-outwardly-facing surfaces thereof) to define fan air chamber 44. (In specific embodiments, such forward-facing surfaces of barrel 30 may comprise an annular fan air delivery face 37, as seen in FIG. 1). A fan air chamber (e.g., 44) is a chamber (i.e., plenum) that accepts air from at least one fan air passage 47 of barrel 30 via at least one fan air passage outlet 47*b* of barrel 30, and that distributes the accepted fan air into at least two separate pathways such that the distributed fan air may shape an atomized liquid spray. Such separate pathways along which the fan air may be distributed may be provided e.g. by air horns 143*a* and 143*b* (seen most easily in FIG. 5, in which air cap 40 is rotated ninety degrees relative to FIG. 4 so that air horns 143*a* and 143*b* may be more easily seen). Air horns 143*a* and 143*b* may each project forward past liquid-emitting orifice 71 of nozzle 210, and each air horn may respectively define air horn cavity 145*a* and 145*b* into which fan air is distributed from fan air chamber 44. Fan air delivered into air horn cavities 145*a* and 145*b* exits the cavities through apertures 146*a* and 146*b* on air horns 143*a* and 143*b*. Apertures 146*a* and 146*b* on horns 143*a* and 143*b* may be e.g. located on generally opposite sides of atomized-liquid-flow axis 100 such that air distributed by fan air chamber 44 flows against generally opposite sides of a stream of liquid emitted from orifice 71 and atomized by center air as described herein. The forces exerted by the fan air can be used to change the shape of the stream of liquid to form a desired spray pattern (e.g., circular, elliptical, etc.). The size, shape, orientation, and other features of the apertures may be adjusted to achieve different fan control characteristics. In the depicted embodiment, the apertures 146*a* and 146*b* are in the form of circular bores.

With reference to the exemplary illustrations of FIGS. 4-6, in some embodiments various surfaces of air cap 40 (e.g., rearward-facing surfaces 147 of flange 144 of air cap 40, and/or radially-inwardly-facing surfaces 149 of annular sidewall 142 thereof, both as shown e.g. in FIG. 5) may combine with various surfaces of barrel 30 (e.g., forward-facing surface 36, and/or radially-outwardly-facing surface 277, both as shown e.g. in FIG. 4) to at least partially define center air chamber 35. (In specific embodiments, such a forward-facing surface of barrel 30 may comprise an annular center air delivery face 36, as seen in FIG. 1.) A center air chamber (e.g., 35) is a chamber (i.e., plenum) that accepts center air from at least one center air passage 33 of barrel 30 via at least one center air passage outlet 34 of barrel 30, and that distributes the accepted center air into at least one center air orifice of inseparable nozzle 210 such that the center air emitted from the orifice can assist in atomizing the liquid emerging from liquid-emitting orifice 71 of nozzle 210. It will thus be appreciated that in embodiments of the general type shown in FIGS. 1-6, center air may travel through a center air passage (e.g., 34) of barrel 30, may exit passage 33 through outlet 34 into center air chamber 35, and from there may travel along the outside of nozzle 210 to enter nozzle air passage(s) 278, in an arrangement referred to herein as external center air flow. It will however be appreciated that, as discussed earlier herein, in such arrangements no part of air cap 40 defines any portion of center air orifice 72. It will also be appreciated that, although a feature such as strut 222 (as depicted in FIGS. 2 and 3) is not visible in the particular view of FIGS. 4-5, some feature of this general type may conveniently be used to support flange 223 as discussed previously herein.

Figure 7:
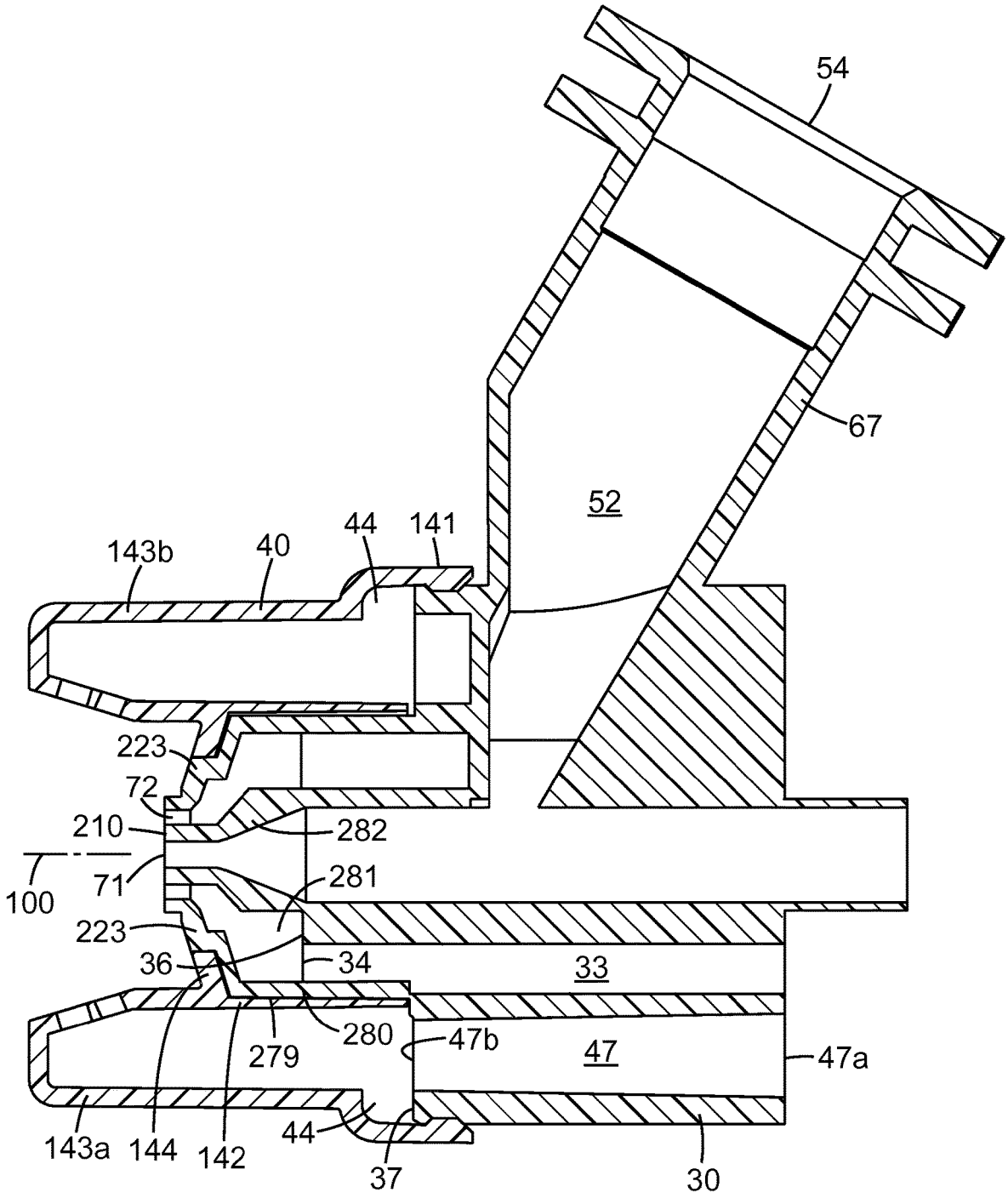
FIG. 7 is a cross-sectional view of an exemplary barrel comprising another exemplary inseparable nozzle.
Figure 8:
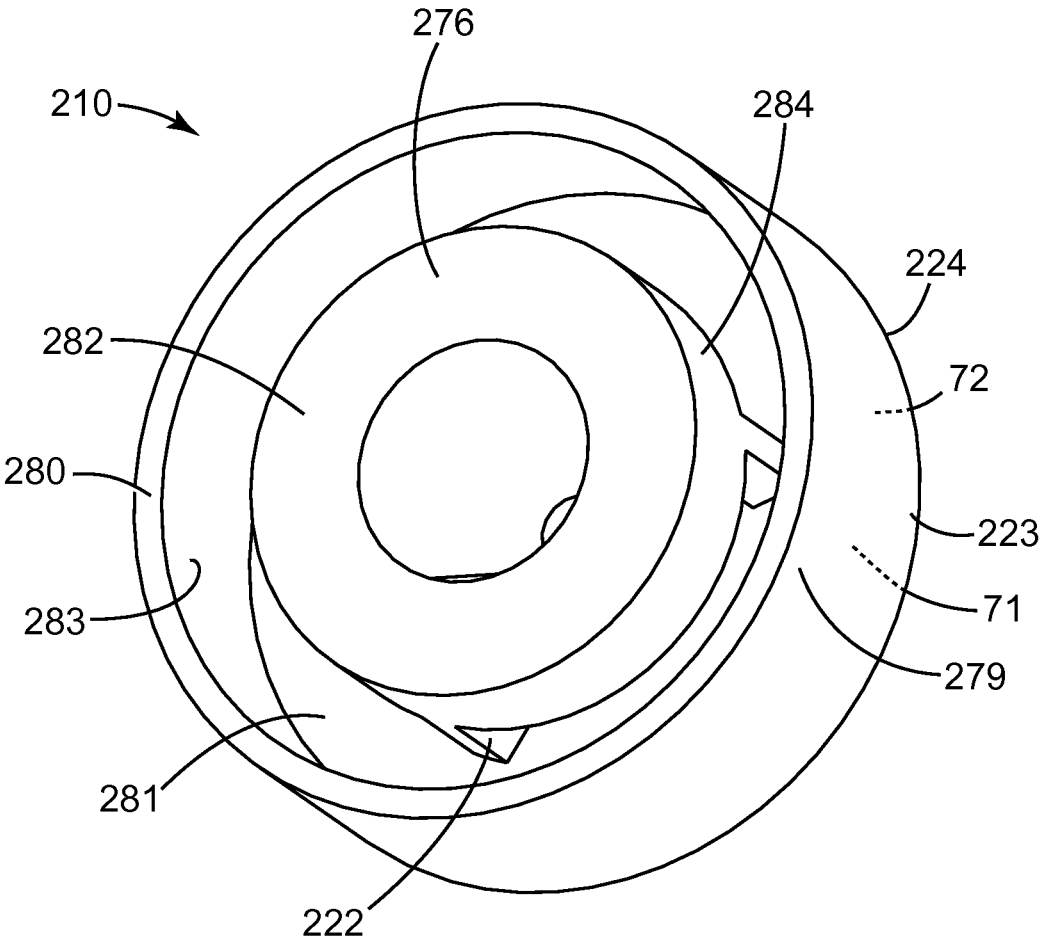
FIG. 8 is an isolated perspective rear view of an exemplary inseparable nozzle.

Other arrangements may involve what is termed internal center air flow. In embodiments of this general type, center air may flow through barrel 30 (e.g., through center air passage(s) thereof) into the interior of inseparable nozzle 210, so as to reach center air orifice 72 without flowing outside of (i.e., through a space radially outward from) nozzle 210. One exemplary arrangement of this type is shown in FIG. 7, which depicts exemplary barrel 30 with inseparable nozzle 210, and in FIG. 8, which is an isolated perspective rear view of the nozzle of FIG. 8, with barrel 30 (and air cap 40) omitted from FIG. 8 so that features of the nozzle can be more easily seen. In such designs, flange 223 of nozzle 210 may extend rearward to form flared skirt 279 a rearmost annular portion (e.g. portion 280) of which abuts center air delivery face 36 of barrel 30, at locations that are radially outward from center air delivery outlet(s) 34. In such a design, center air that exits outlet(s) 34 is captured within an interior center air flow passage 281 that is defined within the interior of nozzle 210 and that fluidly connects to center air orifice 72. Specifically, such an interior center air flow passage 281 may be the space defined between a radially inward facing surface 283 of flared skirt 279 of flange 223, and a radially outward facing surface 284 of inner conduit 282 (through the interior of which liquid may flow in similar manner as described earlier herein to reach liquid-emitting orifice 71).

Abutting of rearmost portion 280 of flared skirt 279 against center air delivery face 36 can be achieved by any suitable method. For example, if nozzle 210 is a separately-made piece that is inseparably attached to barrel 30, portion 280 may be a rearmost face of flared skirt 279 that is pressed against face 36 of barrel 30 so that it is held tightly thereagainst upon the inseparable attachment of nozzle 210 to barrel 30. Or, in embodiments in which nozzle 210 is integrally molded along with barrel 30, skirt 279 (including portion 280 and other portions of flange 223) may be an integral continuation of barrel 30. Flared skirt portion 279 may be connected to (e.g. supported by) other portions of nozzle 210 (e.g., inner conduit 282 and/or shank portion 276 thereof), in any convenient manner (e.g., by ribs similar to previously described ribs 222).

An air cap of any suitable design may be used in embodiments of this type. For example, air cap 40 may comprise flange 144 and sidewall 142 as previously described, although it will be appreciated that in embodiments involving internal center air flow through nozzle 210, flange 144 and/or sidewall 142 may not play a role in directing the flow of center air. That is, it will be appreciated that in embodiments involving internal center air flow, no surface of air cap 40 defines any portion of center air orifice 72 or of center air passage 33, and it will be further recognized that no part of surface of air cap 40 is in contact with, or acts to direct, center air as it flows from center air passage 33 to center air orifice 72. Thus in such embodiments no center air chamber is defined (even in part) by air cap 40. Thus, in such embodiments an air cap may serve only to deliver fan air (and/or possibly to serve in some protective or decorative role). In applications in which fan air is not needed, an air cap may be omitted completely.

In view of the above discussions, it will be appreciated that in embodiments of this type no center air chamber (plenum) need exist as such. That is, it may not be necessary for a center air passage 33 of barrel 30 to terminate (e.g. in a center air face of barrel 30) in the general manner of FIGS. 1 and 8 so that center air emitted from outlet 34 of passage 33 passes into a center air chamber from which it is then distributed into interior center air flow passage(s) 281 of nozzle 210. Instead, for example one or more center air passages may extend e.g. continuously from rear face 42 of barrel 30, to center air orifice 72, so that a portion of the center air passage that is proximate to center air orifice 72 may inherently function as an interior flow passage (e.g., 281) of nozzle 210. In such case flowing center air may not necessarily pass through any type of distribution chamber or plenum. Many such arrangements are possible, and are encompassed by the disclosures herein. It will further be realized that combinations of interior air flow and exterior air flow are possible, and are encompassed by the disclosures herein. (In any such embodiments, the components and arrangements for conveying liquid along liquid-handling passage 53 of barrel 30 to liquid-emitting orifice 71 of inseparable nozzle 210, may be similar to those described herein).

In embodiments in which an air cap 40 is present, it may be attached to barrel 30 and/or to (some portion of) a spray gun platform (e.g., 10). In some embodiments, an air cap may be attachable to barrel 30 but not to a gun platform. In some embodiments, an air cap may be attachable to barrel 30 solely by way of attachment features that are unitary with and integral to (e.g., are molded along with), the air cap (e.g. in combination with attachment features of the barrel that are unitary with and integral to the barrel), without the use of any additional or auxiliary attachment mechanism such as e.g. one or more locking rings, locking caps, nuts, bolts, clips, pins, mechanical fasteners, tapes, adhesives, glues and so on. In other embodiments, an additional or auxiliary attachment mechanism may be used.

In broader embodiments, any suitable method of attaching an air cap to a barrel may be used. Such methods may include the use of e.g. threaded connections on the air cap and/or the barrel and/or on any additional or auxiliary attachment mechanism used therewith. Suitable methods may also include e.g. a bayonet-type mount, a Luer lock connection, a snap fit assembly, a friction-fit connection, and so on. With reference to the particular exemplary configuration illustrated in FIGS. 4-6, in some embodiments air cap 40 may be attached to barrel 30 in a manner that allows for at least partial rotation of air cap 40 (as shown by comparison of FIGS. 4 and 5) e.g. about an axis generally aligned with the axis of liquid flow through liquid-emitting orifice 71 of inseparable nozzle 210 (e.g., axis 100 of FIG. 5). Such a design may allow the orientation of air cap 40 to be adjusted to shape or otherwise adjust the orientation of the pattern of the atomized liquid spray emitted from spray gun 1. One exemplary manner in which air cap 40 can be attached to barrel 30 in such manner as to allow at least partial rotation of air cap 40 is by the use of annular ridge 148 that projects radially inward from at least portions of lip 141 of air cap 40, in combination with radially-outward facing annular groove 38 of barrel 30 into which ridge 148 may mate.

In some embodiments, methods of attachment of air cap 40 to barrel 30 may be used in which an at least partial rotation of air cap 40 relative to barrel 30 (e.g., about an axis generally aligned with the axis of liquid flow through liquid-emitting orifice 71) serves to attach the air cap to the barrel. For example, engaging features (e.g. of the type designated by reference numbers 37, 47, and 47*a* of U.S. Patent Application 61/512,678 filed Jul. 28, 2011) may be provided on air cap 40 and barrel 30, so that rotating of air cap 40 relative to barrel 30 serves to engage the features together and to attach air cap 40 to barrel 30.

An air cap may be made of any suitable material, including e.g. metals, metal alloys, plastics (e.g., moldable thermoplastic polymer resins, optionally containing any suitable additives, reinforcing fillers, etc., for any desired purpose), and the like, and any combinations thereof. In some embodiments, an air cap is made of (e.g., consists of) a single unitary piece of integrally molded plastic, including e.g. the air horns, flange, and any attachment mechanism or feature that is usable to attach the air cap to a barrel. In other embodiments, an air cap may be comprised of at least two pieces that are connected to each other (e.g., a first piece comprising e.g. air horns, and a second piece comprising e.g. a ring (e.g. a locking ring with threaded connections) that is rotatably connected to the first portion and that may be used to attach the air cap e.g. to a barrel). An air cap may be provided to a user already attached to a barrel; or it may be attached thereto by the user. In some embodiments, the air cap is removable from the spray gun. In further embodiments, the air cap is disposable.

Figure 9:
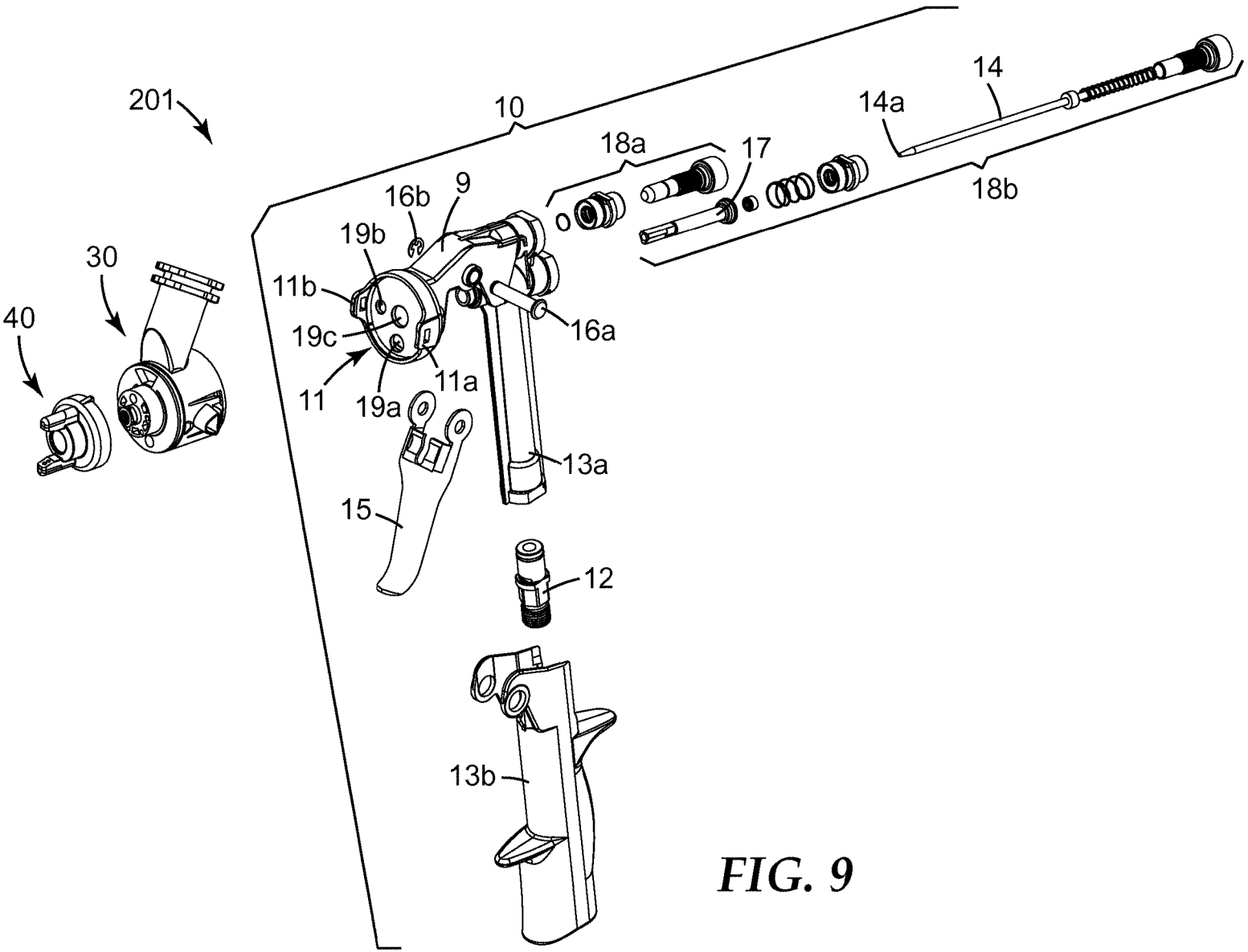
FIG. 9 is an exploded perspective view of an exemplary barrel mounted to an exemplary liquid spray gun platform to form a liquid spray gun.
Figure 10:
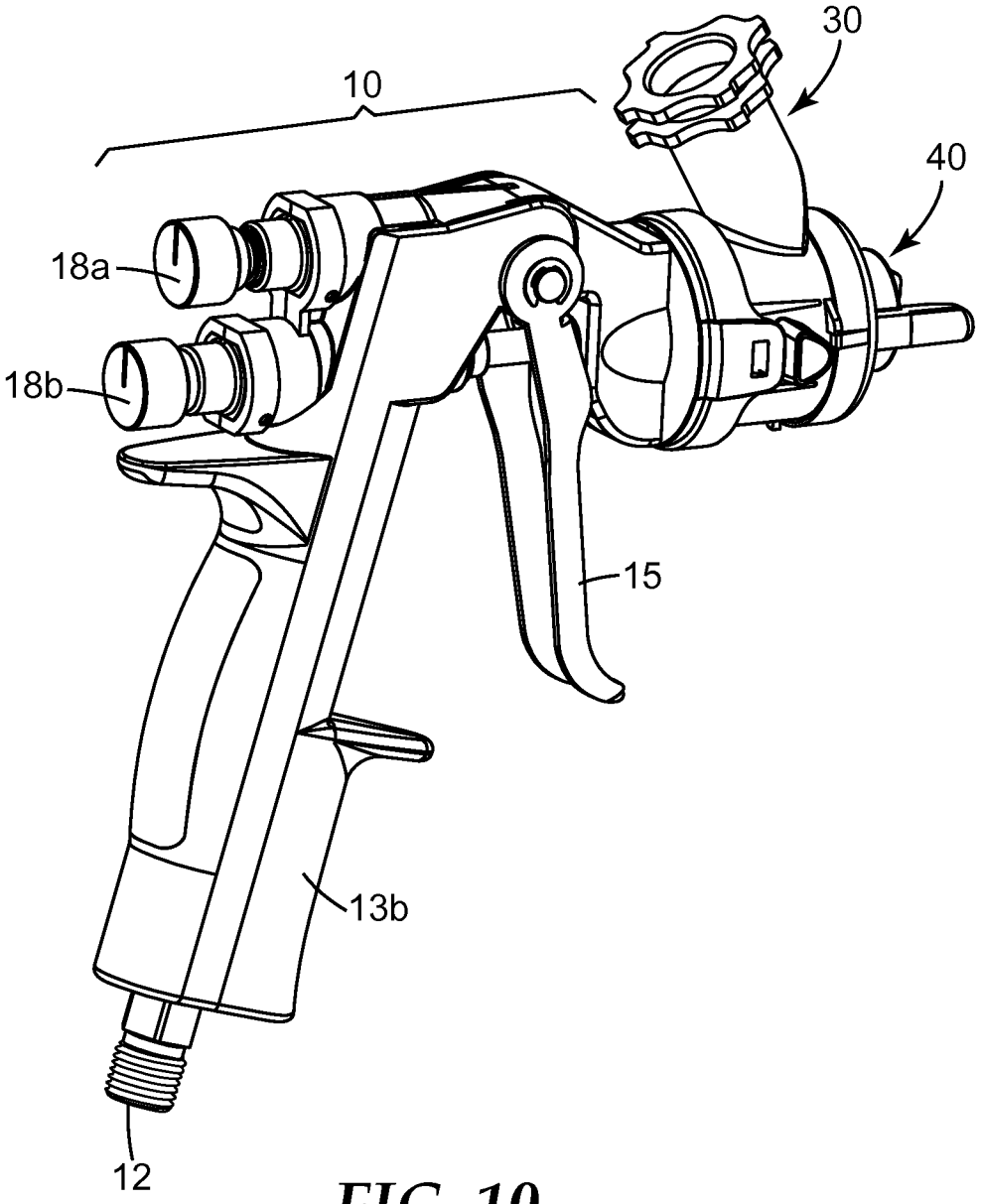
FIG. 10 is a perspective rear view of the liquid spray gun of FIG. 9, as assembled.

Barrel 30 may be used in combination with (e.g., attached to) a liquid spray gun platform (e.g., 10) in order to form a liquid spray gun (e.g., 1), as shown in exemplary illustration in FIGS. 9-10. In embodiments of the general type illustrated in FIGS. 9-10, a rear face 42 of barrel 30 may be mated to spray gun platform interface 11 of liquid spray gun platform 10, and barrel 30 attached to platform 10 by any convenient mechanism.

Attachment of barrel 30 to gun platform 10 may be releasable or non-releasable. In specific embodiments in which such attachment is releasable, barrel 30 may be removable and replaceable (e.g., with a barrel which may be identical to the removed barrel, or may be different, e.g. chosen in view of the particular characteristics of the liquid to be sprayed for a given application). In specific embodiments in which such attachment is non-releasable, a barrel may comprise a separately-made piece which is non-releasably attached to a gun platform; or, it may be integrated a gun platform (e.g., into frame 9 of gun platform 10). Given the above discussion, it will be appreciated that the concept of an attachable barrel broadly encompasses configurations in which a barrel is provided to a user as a component that is attachable by the user to a gun platform, as well as configurations in which a barrel as provided to the user is already attached to, or indeed integrated into, a gun platform.

Releasable or non-releasable attachment of barrel 30 to spray gun platform 10 may be achieved by any suitable mechanism. For example with reference to the exemplary embodiments of FIGS. 1 and 9-10, attachment structures 39 (e.g., tabs) of barrel 30 may cooperate (e.g., mechanically interlock) with openings 11*a* and 11*b* of platform 10 to retain barrel 30 in place thereon. If the attachment is desired to be releasable such that a user in the field can release barrel 30 from platform 10, attachment structures 39 may e.g. be manually inwardly deflectable, e.g. by way applying inward pressure to stobs 139, so that they can be inwardly released from openings 11*a* and 11*b*. It will be recognized that many other releasable or non-releasable attachment techniques and/or structures, on barrel 30 and platform 10, may be used in place of those described herein, e.g., a bayonet type connection that facilitates rapid connection/disconnection of barrel 30 with a simple push or push-twist action, clamps, threaded connections, etc. In some specific embodiments, however, the attachment between barrel 30 and platform 10 is not by way of a threaded connection between the two.

In embodiments in which barrel 30 is releasable (removable) from liquid spray gun platform 10, barrel 30 may be cleaned and reused, as the user desires. In particular embodiments, barrel 30 is disposable. As used herein, the term "disposable" denotes a component that, in ordinary operation of a spray gun, (e.g., during changeover from one paint to another), is customarily removed and disposed after a selected period of use, e.g. even if the component is still in good working order. This should be distinguished from spray gun components that (even though it might be possible to remove them e.g. if they become damaged) are customarily retained and reused repeatedly in ordinary operation of a spray gun. Although not shown in any Figure, if desired an elastomeric junction may be provided e.g. between certain portions of rear face 42 of barrel 30, and interface 11 of gun platform 10. Such elastomeric junctions may serve to reduce air leakage from e.g. the junction of center air supply conduit outlet 19*b* of platform 10, and center air passage inlet 31 of barrel 30, and/or the junction of fan air supply conduit outlet 19*a* of platform 10 and fan air passage inlet 47*a* of barrel 30. Such elastomeric junctions may be provided e.g. by one or more elastomeric gaskets or the like, that may e.g. be fastened to barrel 30 and/or gun platform 10. If desired, an elastomeric gasket may be provided around some or all of the perimeter of rear face 42 of barrel 30, to reduce overall air leakage from spray gun 1. Such an elastomeric gasket or gaskets may be conveniently provided e.g. by overmolding an elastomeric thermoplastic material over a barrel 30. Such an overmolded piece may also have portions that serve other purposes. For example, if barrel 30 comprises slits of the general type shown in FIG. 1 (that may serve to allow inward deflection of portions of barrel 30 so that e.g. attachment tabs 39 can be radially-inwardly disengaged from slots 11*a* and 11*b* of platform 10), an overmolded elastomeric shroud or liner portion may abut the slits so as to reduce air leaks therethrough while still permitting sufficient deflection of attachment tabs 39.

With further reference to FIG. 9, exemplary spray gun platform 10 may comprise a frame 9 on which other components of platform 10 may be provided. As mentioned above, gun platform 10 may comprise at least a generally forward-facing interface 11, which is configured to mate with rear face 42 of barrel 30 as described above. Interface 11 of gun platform 10 may comprise opening 19*c* that may be configured to receive at least a rearmost section of shank 58 of barrel 30. Gun platform 10 may comprise a stem portion 13*a*, which may also include an optional handle 13*b* that fits over the stem portion 13*a* of gun platform 10. Handle 13*b* may, in some embodiments, be custom designed according to the operator's preference, including custom fitting by means of a thermosetting resin. Frame 9 and/or other components of spray gun platform 10 may be constructed of any suitable material that can be molded, cast, etc. to form the features described herein. Examples of some potentially suitable materials may include, e.g., metals, metal alloys, polymers (e.g., polyurethanes, polyolefins (e.g., polypropylenes), polyamides (e.g., nylons including amorphous nylons), polyesters, fluoropolymers, and polycarbonates), and others, including any combinations thereof. Selection of the materials used in gun platform 10 may be based at least in part on the compatibility of the selected materials with the liquids to be sprayed (e.g., solvent resistance and like characteristics).

Spray gun platform 10 may include needle 14 that can be used to control flow of liquid through spray gun 1. Referring to FIG. 9, control over both air flow and liquid flow through the liquid spray gun may, in the depicted exemplary embodiment, be provided by a trigger 15 that is pivotally engaged to the spray gun platform 10 by a retaining pin 16*a* and clip 16*b* (although any other suitable connection mechanism could be used). Trigger 15 is operatively connected to needle 14, which may extend through chamber 56 within barrel 30, such that liquid that enters chamber 56 from liquid-handling junction 57 can then follow, through this portion of liquid-handling passage 53, a path that is generally aligned with the longitudinal axis of needle 14 and that leads to liquid-emitting orifice 71 of inseparable nozzle 210. It may be convenient to bias needle 14 (e.g., via biasing of trigger 15) to a position in which tapered front end 14*a* of needle 14 closes liquid-handling passage 53 of barrel 30 (e.g., by way of tapered front end 14*a* of needle 14 contacting inward-facing surface 74 of liquid-handling passage 53). Overcoming the biasing force (e.g., by applying pressure to trigger 15) results in needle 14 being retracted and liquid being allowed to flow through liquid-handling passage 53 and out of liquid-emitting orifice 71.

A spray gun platform (e.g. 10) may define a variety of conduits that, individually and/or in combination, supply air to barrel 30. With reference to the exemplary embodiment of FIG. 9, spray gun platform 10 may include e.g. a fitting 12 such that the air supply conduit(s) in spray gun platform 10 can be connected to an air source (not shown) that supplies air to spray gun platform 10 at greater than atmospheric pressure. It may be convenient to configure gun platform 10 so that when needle 14 is in the forwardly-biased position air supply valve 17 is closed and so that trigger 15 is operatively connected to air supply valve 17 so that overcoming the biasing force to allow liquid to flow as described above, also results in air flowing through the air supply conduits of gun platform 10 and therefrom into air-handling passages of barrel 30. Such a biasing force may be provided e.g. by a coil spring (positioned between air supply valve 17 as part of the center air control assembly 18*b*), although other biasing mechanisms may be used and those biasing mechanisms may be located in other positions (e.g., between the trigger 15 and the handle 13*b*). In the illustrated embodiment, when trigger 15 is depressed needle 14 is retracted to a position in which tapered front end 14*a* allows liquid to flow forwardly through liquid-handling passage 53 of barrel 30. At the same time, air supply valve 17 is opened to supply air to air-handling passages of barrel 30 from the air supply conduits in spray gun platform 10. Such air flow may conveniently be in the form of fan air flow and center air flow which may be e.g. supplied through platform 10, and/or delivered through barrel 30, along separate, unconnected paths. Fan air flow may be controlled e.g. by a fan air control assembly 18*a* that controls the air supplied to fan air supply conduit outlet 19*a* of gun platform interface 11. Center air flow may be controlled e.g. by a center air control assembly 18*b* which controls air supplied to center air supply conduit outlet 19*b* of gun platform interface 11. In particular, control assembly 18*b* may control center air flow (that e.g. flows from center air orifice 72 of inseparable nozzle 210 and that is used to assist in atomizing the liquid emerging from liquid-emitting orifice 71) and control assembly 18*a* may control fan air flow (that e.g. flows from fan air apertures in air cap 40 and that is used to adjust the spray pattern geometry).

In the illustrated embodiment of FIGS. 1 and 9, center air outlet 19*b* of platform 10 may be mated to at least one inlet 31 of at least one center air passage 33 of barrel 30, so that center air can be thereby delivered (e.g., via outlet 34 of center air passage 33) into center air chamber 35 that can serve to distribute the center air into one or more center air streams arranged e.g. in radially-outward proximity to liquid-emitting orifice 71 of nozzle 210 to facilitate the atomization of liquid emerging therefrom into a fine spray. Similarly, fan air conduit outlet 19*a* of platform 10 may be mated to at least one inlet 47*a* of at least one fan air passage 47 of barrel 30, so that fan air can be thereby delivered into fan air chamber 44 (and, e.g., hencefrom into air horn cavities 145*a* and/or 145*b*) where it can help adjust the spray pattern geometry.

It should be understood that the above arrangements of air delivery systems and components of gun platform 10, and in particular the details of how air supply conduits of gun platform 10 may be mated to air-handling passages of barrel 30, are presented only for purposes of illustrating exemplary embodiments. The ordinary artisan will appreciate that numerous possible components and arrangements are possible, and may be used within the scope of the disclosures herein. Moreover, it will be understood in a more general sense that all of the components and arrangements of gun platform 10 discussed herein with reference to FIGS. 9-10 are presented only for purposes of illustrating exemplary embodiments. Any suitable design of a gun platform and of components thereof (e.g., those in which certain components are unitary with, and integrally made with, a frame, those in which certain components are separately-made pieces that are attached to a frame, those in which various components are metal, metal alloy, or plastic, etc.) may be used within the scope of the disclosures described herein.

LIST OF EXEMPLARY EMBODIMENTS

Embodiment 1

A barrel for use with a liquid spray gun platform to provide a liquid spray gun, comprising: a main body comprising at least one center air delivery passage and at least one liquid-handling passage; and, an inseparable nozzle, wherein the nozzle defines a liquid-emitting orifice that is in fluid communication with the at least one liquid-handling passage of the main body, and wherein the nozzle defines a center air orifice that is in fluid communication with the at least one center air delivery passage of the main body.

Embodiment 2

The barrel of embodiment 1 wherein the main body of the barrel and the inseparable nozzle are a unitary piece of piece of integrally molded plastic.

Embodiment 3

The barrel of any of embodiments 1-2 further comprising an air cap that is attached to the barrel and that comprises at least two air horns that project forward past the liquid-emitting orifice of the barrel and that collectively comprise apertures at least some of which are located on opposite sides of an axis generally aligned with a direction of liquid flow through the liquid-emitting orifice of the barrel.

Embodiment 4

The barrel of embodiment 3 wherein surfaces of the barrel and surfaces of the air cap combine to at least partially define a fan air chamber that is configured to distribute fan air to the at least two air horns.

Embodiment 5

The barrel of any of embodiments 3-4 wherein no surface of the air cap defines any portion of the center air orifice or of the center air delivery passage, and further wherein no surface of the air cap is in contact with, or acts to direct, center air as it flows from the center air deliver passage to the center air orifice.

Embodiment 6

The barrel of any of embodiments 3-4 wherein surfaces of the barrel and surfaces of the air cap combine to at least partially define a center air chamber that is configured to distribute center air to the center air orifice of the barrel.

Embodiment 7

The barrel of any of embodiments 2-6 wherein the air cap is a unitary piece of integrally molded plastic and wherein the air cap is attached to the barrel by way of attachment features of the air cap that are unitary with, and integrally molded with, the air cap.

Embodiment 8

The barrel of any of embodiments 1-7 wherein the barrel is releasably attachable to the liquid spray gun platform.

Embodiment 9

The barrel of any of embodiments 1-7 wherein the barrel is non-releasably attached to the liquid spray gun platform.

Embodiment 10

The barrel of any of embodiments 1-9 wherein the barrel comprises an elongate interior chamber that is in fluid communication with the liquid-emitting orifice and further comprises a hollow, angled protruding portion that protrudes outward at an angle from the elongate interior chamber, that comprises a liquid-handling passage inlet of the barrel; and, that comprises a liquid-entry passage that is fluidly connected to the liquid-handling passage inlet of the barrel and that is fluidly connected, by way of a liquid-handling junction, to the elongate interior chamber of the barrel.

Embodiment 11

The barrel of any of embodiments 1-10 wherein the inseparable nozzle comprises an annular tip that defines the liquid-emitting orifice and further comprises a flange at least a portion of which is radially outwardly separated from the annular tip so that the center air orifice is defined between radially outward-facing surfaces of the annular tip and radially inward-facing surfaces of the flange.

Embodiment 12

The barrel of embodiment 11 wherein the flange extends rearward to form a flared skirt that defines an interior center air flow path within the nozzle, which interior center air flow path receives air from the at least one center air passage of the barrel.

Embodiment 13

The barrel of embodiment 12 wherein a rearmost portion of the flared skirt abuts, or is integrally connected to, a center air delivery face of the barrel, at locations that are radially outward from center air outlets on the center air delivery face.

Embodiment 14

The barrel of any of embodiments 1-13 wherein the barrel comprises a front-facing annular center air delivery face and a front-facing annular fan air delivery face.

Embodiment 15

A liquid spray gun comprising the barrel of any of embodiments 1-14 attached to a liquid spray gun platform.

Embodiment 16

The liquid spray gun of embodiment 15 comprising the barrel of any of embodiments 1-2 and 8-14 wherein the liquid spray gun does not comprise an air cap.

Embodiment 17

A method of spraying liquid, the method comprising using the liquid spray gun of any of embodiments 15-16 to spray liquid.

Embodiment 18

The method of embodiment 17 wherein the liquid is paint.

Illustrative embodiments of barrels, inseparable nozzles thereof, and of air caps and of liquid spray gun platforms that may be used therewith, have been discussed and reference has been made to possible variations. It will be apparent to those skilled in the art that the specific exemplary structures, features, details, configurations, etc., that are disclosed herein can be modified and/or combined in numerous embodiments. All such variations and combinations are contemplated by the inventor as being within the bounds of the conceived invention, not merely those representative designs that were chosen to serve as exemplary illustrations. Thus, the scope of the present invention should not be limited to the specific illustrative structures described herein, but rather extends at least to the structures described by the language of the claims, and the equivalents of those structures. As used herein, the term "liquid" refers to all forms of flowable materials that can be applied to a surface using a spray gun or other spray apparatus (whether or not they are intended to color the surface) including (without limitation) paints, primers, base coats, lacquers, varnishes and similar paint-like materials, as well as other materials such as, e.g., adhesives, sealers, fillers, putties, powder coatings, blasting powders, abrasive slurries, agricultural liquids/solutions (e.g., fertilizers, herbicides, insecticides, etc.), mold release agents, foundry dressings, etc. which may, in some embodiments, be applied in atomized form depending on the properties and/or the intended application of the material. The term "liquid" is to be construed accordingly. The term "air" is used for convenience and broadly encompasses the use of any suitable gaseous composition or mixture (e.g., nitrogen, inert gases, and so on). The term "atomize" is likewise used for convenience to refer to transforming a liquid into a fine spray and does not require transforming the liquid into individual molecules or atoms. As used herein as a modifier to a property or attribute, the term "generally" means that the property or attribute would be readily recognizable by a person of ordinary skill but without requiring absolute precision or a perfect match (e.g., within +/−20% for quantifiable properties); the term "substantially" means to a high degree of approximation (e.g., within +/−5% for quantifiable properties) but again without requiring absolute precision or a perfect match. To the extent that there is a conflict or discrepancy between this specification as written and the disclosure in any document incorporated by reference herein, this specification as written will control.

What is claimed is:

1. A barrel for use with a liquid spray gun platform to provide a liquid spray gun, comprising:

a main body comprising at least one center air delivery passage and at least one liquid-handling passage; and, an inseparable nozzle comprising an annular tip that defines a liquid-emitting orifice that is in fluid communication with the at least one liquid-handling passage of the main body, a flange at least a portion of which is radially outwardly separated from the annular tip in a direction orthogonal to an axis of liquid flow and completely surrounds the annular tip so that an annular center air orifice is defined between an outward facing surface of the annular tip and an inward facing surface of the flange, the center air orifice being in fluid communication with the at least one center air delivery passage of the main body;

wherein the center air orifice is defined only by surfaces of the inseparable nozzle, wherein air and liquid exit the liquid spray gun at the center air orifice and liquid-emitting orifice, respectively, wherein air emerging from the center air orifice atomizes liquid emerging from the liquid-emitting orifice, and wherein the barrel is releasably attachable to the liquid spray gun platform by way of one or more attachment structures such that a user in the field can release the barrel from the liquid spray gun platform.

2. The barrel of claim 1 wherein the main body of the barrel and the inseparable nozzle are a unitary piece of integrally molded plastic.

3. The barrel of claim 1 further comprising an air cap that is attachable to the barrel and that comprises at least two air horns that project forward past the liquid-emitting orifice of the barrel and that collectively comprise apertures at least some of which are located on opposite sides of an axis generally aligned with a direction of liquid flow through the liquid-emitting orifice of the barrel.

4. The barrel of claim 3 wherein surfaces of the barrel and surfaces of the air cap combine to at least partially define a fan air chamber that is configured to distribute fan air to the at least two air horns.

5. The barrel of claim 4 wherein no surface of the air cap defines any portion of the center air orifice or of the center air delivery passage, and further wherein no surface of the air cap is in contact with, or acts to direct, center air as it flows from the center air delivery passage to the center air orifice.

6. The barrel of claim 4 wherein other surfaces of the barrel and other surfaces of the air cap combine to at least partially define a center air chamber that is configured to distribute center air to the center air orifice of the barrel.

7. The barrel of claim 3 wherein the air cap is a unitary piece of integrally molded plastic and wherein the air cap is attached to the barrel by way of attachment features of the air cap that are unitary with, and integrally molded with, the air cap.

8. The barrel of claim 1 wherein the barrel comprises an elongate interior chamber that is in fluid communication with the liquid-emitting orifice and further comprises a hollow, angled protruding portion that protrudes outward at an angle from the elongate interior chamber, that comprises a liquid-handling passage inlet of the barrel; and, that comprises a liquid-entry passage that is fluidly connected to the liquid-handling passage inlet of the barrel and that is fluidly connected, by way of a liquid-handling junction, to the elongate interior chamber of the barrel.

9. The barrel of claim 1 wherein the flange extends rearward to form a flared skirt that defines an interior center air flow path within the nozzle, which interior center air flow path receives air from the at least one center air passage of the barrel.

10. The barrel of claim 9 wherein a rearmost portion of the flared skirt abuts, or is integrally connected to, a center air delivery face of the barrel, at locations that are radially outward from a center air outlet on the center air delivery face.

11. The barrel of claim 1 wherein the barrel comprises a front-facing annular center air delivery face and a front-facing annular fan air delivery face.

12. A liquid spray gun comprising the barrel of claim 1 attached to a liquid spray gun platform.

13. The liquid spray gun of claim 12 wherein the liquid spray gun does not comprise an air cap.

14. The barrel of claim 1 wherein the inseparable nozzle comprises a rib, the rib supports the flange and is connected to another portion of the inseparable nozzle.

15. A method of spraying liquid, the method comprising providing a liquid spray gun comprising:

a barrel attachable to a liquid spray gun platform, the barrel comprising:

a main body comprising at least one center air delivery passage and at least one liquid-handling passage; and, an inseparable nozzle comprising an annular tip that defines a liquid-emitting orifice that is in fluid communication with the at least one liquid-handling passage of the main body, a flange at least a portion of which is radially outwardly separated from the annular tip in a direction orthogonal to an axis of liquid flow that completely surrounds the annular tip so that an annular center air orifice is defined between an outward facing surface of the annular tip and an inward facing surface of the flange, the center air orifice being in fluid communication with the at least one center air delivery passage of the main body;

wherein the center air orifice is defined only by surfaces of the inseparable nozzle, wherein air and liquid exit the liquid spray gun at the center air orifice and liquid-emitting orifice, respectively, wherein air emerging from the center air orifice atomizes liquid emerging from the liquid-emitting orifice;

a trigger and a needle; and applying pressure to the trigger to retract the needle such that a liquid is allowed to flow through the liquid-handling passage and out of the liquid-emitting orifice to spray the liquid.

16. The method of claim 15 wherein the liquid is paint.

17. A barrel for use with a liquid spray gun platform, comprising:

a main body comprising at least one center air delivery passage and at least one liquid-handling passage; and, an inseparable nozzle comprising an annular tip that defines a liquid-emitting orifice that is in fluid communication with the at least one liquid-handling passage of the main body, a flange at least a portion of which is radially outwardly separated from the annular tip in a direction orthogonal to an axis of liquid flow and a rim extending from the flange, the rim completely surrounds the annular tip so that an annular center air orifice is defined between an outward facing surface of the annular tip and an inward facing surface of the rim, the center air orifice being in fluid communication with the at least one center air delivery passage of the main body;

wherein the center air orifice is defined only by surfaces of the inseparable nozzle, wherein air and liquid exit the liquid spray gun at the center air orifice and liquid-emitting orifice, respectively, wherein air emerging from the center air orifice atomizes liquid emerging from the liquid-emitting orifice.

18. A kit, comprising:

a barrel attachable to a liquid spray gun platform, the barrel comprising:

a main body comprising at least one center air delivery passage and at least one liquid-handling passage; and, an inseparable nozzle comprising an annular tip that defines a liquid-emitting orifice that is in fluid communication with the at least one liquid-handling passage of the main body, a flange at least a portion of which is radially outwardly separated from the annular tip in a direction orthogonal to an axis of liquid flow that completely surrounds the annular tip so that an annular center air orifice is defined between an outward facing surface of the annular tip and an inward facing surface of the flange, the center air orifice being in fluid communication with the at least one center air delivery passage of the main body;

wherein the center air orifice is defined only by surfaces of the inseparable nozzle, wherein air and liquid exit the liquid spray gun at the center air orifice and liquid-emitting orifice, respectively, wherein air emerging from the center air orifice atomizes liquid emerging from the liquid-emitting orifice;

an air cap that is attachable to the barrel and that comprises at least two air horns that project forward past the liquid-emitting orifice of the barrel and that collectively comprise apertures at least some of which are located on opposite sides of an axis generally aligned with a direction of liquid flow through the liquid-emitting orifice of the barrel.

19. The kit of claim 18, wherein surfaces of the barrel and surfaces of the air cap are configured to combine to at least partially define a fan air chamber that is configured to distribute fan air to the at least two air horns.

20. The kit of claim 19, wherein no surface of the air cap defines any portion of the center air orifice or of the center air delivery passage, and further wherein no surface of the air cap is in contact with, or acts to direct, center air as it flows from the center air delivery passage to the center air orifice.

21. The kit of claim 19, wherein other surfaces of the barrel and other surfaces of the air cap combine to at least partially define a center air chamber that is configured to distribute center air to the center air orifice of the barrel.

22. The kit of claim 18, wherein surfaces of the barrel and surfaces of the air cap combine to at least partially define a fan air chamber that is configured to distribute fan air to the at least two air horns.

23. The kit of claim 18, wherein the barrel is integrated into the liquid spray gun platform and is thus non-releasably attached to the liquid spray gun platform.

* * * * *